United States Patent [19]

Short et al.

[11] 3,943,865

[45] Mar. 16, 1976

[54] CONTROLLED DELIVERY OF YARN

[75] Inventors: Joe T. Short, West Point; Lee H. Knight, Jr., Savannah; Zane Frentress, Chamblee; Winston C. Boteler, Atlanta, all of Ga.

[73] Assignee: Deering Milliken Research Corporation, Spartanburg, S.C.

[22] Filed: Mar. 6, 1970

[21] Appl. No.: 17,312

Related U.S. Application Data

[63] Continuation of Ser. No. 798,846, Dec. 23, 1968, abandoned, which is a continuation of Ser. No. 535,640, March 7, 1966, abandoned.

[52] U.S. Cl. ..... 112/79 R

[51] Int. Cl.[2] ..... D05C 15/18; D05C 15/32

[58] Field of Search ..... 112/79 R, 79 A, 266, 410; 66/132, 84, 86 A; 318/138; 310/49

[56] References Cited

UNITED STATES PATENTS

| | | | |
|---|---|---|---|
| 2,784,689 | 3/1957 | MacCaffray, Jr. | 112/79 A |
| 2,932,181 | 4/1960 | MacCaffray, Jr. | 112/79 A X |
| 2,940,405 | 6/1960 | Parlin | 112/79 A |
| 3,001,388 | 9/1961 | MacCaffray, Jr. | 112/79 A X |
| 3,016,029 | 1/1962 | Card | 112/79 A |
| 3,089,442 | 5/1963 | Short | 112/79 R |
| 3,203,378 | 8/1965 | Dedmon | 112/79 R |
| 3,241,017 | 3/1966 | Madsen et al. | 318/138 |
| 3,247,815 | 4/1966 | Polevitzky | 112/79 R |
| 3,327,499 | 6/1967 | Schmidt et al. | 112/79 R |

*Primary Examiner*—Werner H. Schroeder
*Attorney, Agent, or Firm*—Luke J. Wilburn, Jr.; H. William Petry

[57] ABSTRACT

A method and apparatus for use in a tufting operation to advance variable yarn lengths toward the needles of a tufting machine for the formation of tufted pile loops having lengths varied in accordance with a predetermined pattern.

5 Claims, 9 Drawing Figures

INVENTORS
Joe T. Short
Lee H. Knight, Jr.
Zane Frentress
Winston C. Boteler
BY Newton, Hopkins, Jones & Ormsby
ATTORNEYS

CONTROLLED DELIVERY OF YARN

CROSS REFERENCE TO RELATED APPLICATION

This is a continuation of our copending application, Ser. No. 798,846 filed Dec. 23, 1968, now abandoned, which is itself a continuation of our previous application Ser. No. 535,640 filed Mar. 7, 1966, now abandoned.

BACKGROUND OF THE INVENTION:

1. Field of the Invention:

This invention relates to yarn feeding and, more particularly to the controlled delivery of yarn from a yarn source to a feeding means such as a needle.

2. Description of the Prior Art:

There is a wide variety of products which are formed by feeding one or more lengths of yarn through a backing material. Usually, each length of yarn is fed through the backing material by successive movements of a needle or similar device and in many of these products it is desired that each length of yarn fed through the backing material be varied in a predetermined manner with successive movements of the needle or similar device. Typical of products of this type are tufted fabrics in which loops of yarn define a pattern.

It is to the production of products such as tufted fabrics that the invention disclosed herein is ideally suited. This is because such products characteristically require that the lengths of yarn fed through a backing material be delivered to a needle or similar device in a controlled manner in order to provide loops of yarn of a selected height or of a plurality of selected heights and because such yarn length control has not been satisfactorily provided by the prior art.

For example, loop length control in the prior art has generally been achieved by controlling the length of yarn delivered to a needle throughout each stitching cycle of a tufting machine. Since the length of yarn which must be delivered throughout a stitching cycle for a loop of yarn of relatively low height is less than the length of yarn which must be delivered throughout s stitching cycle for a loop of yarn of greater height, the yarn is usually delivered at different yarn delivery rates to a needle during successive stitching cycles.

In the prior art, this change in yarn delivery rate from one stitching cycle to the next is generally not well defined and causes a pattern formed by loops of yarn of varying height to be poorly defined. Moreover, this change in yarn delivery rate from one stitching cycle to the next places the yarn during successive stitching cycles under varying degrees of tension. With yarn having a relatively high degree of elasticity, these varying degrees of tension, in the relatively long lengths of yarn which characterize yarn length control in the prior art, result in slackening and tightening of the lengths of yarn and in conditions such as bowstring vibrations in the lengths of yarn, friction between adjacent lengths of yarn, frequent entanglement of adjacent lengths of yarn, and where fluid pressure is being used to feed the lengths of yarn, variations in the amount of fluid pressure required to feed the yarn. When any of these conditions exists in the delivery of yarn, it is difficult to avoid frequent yarn breakage or to prevent one loop of yarn from having different characteristics from another loop of yarn.

It is also characteristic of yarn length control in the prior art for the length of yarn delivered to a needle for forming a loop of yarn of a particular height to include not only that length of yarn required for the loop of yarn but also that length of yarn required for a back stitch. Thus, the change in yarn delivery rate from one stitching cycle to the next which is generally characteristic of yarn length control in the prior art also results in those particular lengths of yarn required for the formation of back stitches being delivered over varying portions of the stitching cycles, each portion being dependent upon yarn delivery rate. The formation of back stitches can be more uniform if the particular length of yarn required for a back stitch is delivered to a needle during that portion of each stitching cycle in which back stitches are formed. Such uniformity is difficult to achieve where backstitch lengths of yarn, as in the prior art, are delivered during the loop forming portions of the stitching cycles.

Moreover, the failure of yarn length control in the prior art to deliver a particular length of yarn, such as the length of yarn required for a back stitch, during a particular portion of a stitching cycle, rather than during the entire stitching cycle, makes that coordination between needle motion and the delivery of a length of yarn which is necessary for the formation of floats on the back of a tufted fabric difficult to achieve. Either a failure to achieve this coordination or the lack of back stitch uniformity frequently encountered in the prior art will serve to cause a lack of uniformity in loops of yarn and poor pattern definition.

Yarn length control in the prior art is not only characterized by the foregoing and other difficulties in controlling the length of yarn delivered to a needle, but it is also frequently characterized by limitations in the variations in the lengths of yarn which can be obtained and in the speed at which they can be obtained. These limitations in turn limit the variety of patterns which can be obtained for a tufted fabric and the speed at which a tufting machine may be operated.

Where these limitations have been individually avoided in the prior art, they have been avoided only by the use of apparatus in which the means for delivering the varying lengths of yarn required for a pattern is difficult and expensive to manufacture and maintain. Moreover, almost all apparatus required for yarn length control in the prior art have caused expensive down time of a tufting machine when a change in pattern is desired.

SUMMARY OF THE INVENTION:

The invention disclosed herein overcomes these and other difficulties and limitations encountered in the prior art in the delivery of yarn to a needle as a result of one or more of the following features of the invention. The invention may deliver in an improved manner yarn at a constant yarn delivery rate to the needle and with the length of yarn delivered during each stitching cycle being determined by the length of time during the stitching cycle that the yarn is being delivered rather than by the yarn delivery rate at which the yarn is being delivered. In addition, the invention provides for the delivery during selected portions of selected stitching cycles of a controlled length of yarn for a back stitch and a separate controlled length of yarn for one or more loops of yarn. Moreover, the invention may advance yarn increments of uniform length varying the number of increments advanced in successive cycles to selectively vary the length of different loops in accordance with a predetermined pattern.

Since the invention may deliver yarn at a constant yarn delivery rate to a needle regardless of the amount of yarn to be delivered, the different lengths are delivered under the same tension. Moreover, the invention may be readily practiced with or embodied in apparatus which delivers a length of yarn to a needle from a point relatively close to the needle. Thus, even with yarn having a relatively high degree of elasticity, the slackening and tightening in the lengths of yarn and the resulting bowstring vibrations in the lengths of yarn, friction between adjacent lengths of yarn, the entanglement of adjacent lengths of yarn which have characterized the prior art are effectively eliminated. The absence of slackening and tightening in the lengths of yarn also makes the invention ideally suited to the feeding of yarn through a needle by the flow of a fluid.

Moreover, where loops of yarn of varying height are used to form a pattern, the control over the length of yarn delivered to each needle during each stitching cycle which is provided by varying the duration of yarn delivery results in a pattern definition which is superior to that obtained in the prior art. Similarly, the control provided by the invention over the length of yarn delivered to each needle during each stitching cycle provides a back stitch uniformity not possible in the prior art. This is because the lengths of yarn required for the forming of back stitches may be readily delivered during that portion of each stitching cycle in which back stitches are formed rather than during varying portions of a stitching cycle as in the prior art. This control over the delivery of lengths of yarn also provides for the delivery of a length of yarn during that portion of a stitching cycle required for that coordination between needle motion and the delivery of a length of yarn which is necessary for the forming of floats on the back of a tufted fabric.

In addition to these and other advantages with respect to the precise control of lengths of yarn, the invention provides this control at substantially any practical tufting machine speed of operation and in a manner which permits the almost instantaneous changing of patterns defined by various lengths of yarn. Thus, the invention substantially eliminates the limitation on tufting machine speed and the expensive down time of a tufting machine which have characterized yarn length control in the prior art. Furthermore, patterns are provided by the invention in a manner which permits an almost unlimited variety of patterns, each of which is relatively inexpensive to establish and maintain. This is because every length of yarn can be independently controlled over the entire width of a tufted fabric and over substantially any practical length of a tufted fabric with a compact and relatively inexpensive pattern means. Further, subtle pattern variations may easily be established by delivery of variable numbers of short, uniform increments of yarn.

These and other improvements in the delivery of yarn for yarn length control are disclosed herein in terms of a yarn delivery apparatus including a delivery means having a plurality of yarn advancing means, such as feed roller means, mounted at fixed feeding stations along the respective yarns. Each of said yarn advancing means delivers yarn to a needle, preferably by intermittant operation and at a substantially constant yarn delivery rate. The delivery means also includes a plurality of separate driving means for respectively driving said advancing means. The duration of time during which the driving means operates determines the length of yarn delivered to the needle. The yarn delivery apparatus also includes a control means for varying the duration of time during which the driving means operates over a wide range in order to provide for a wide range of yarn lengths and where desired, to provide for a plurality of separate lengths of yarn, such as those for a back stitch and a loop of yarn, during each stitching cycle. Thus, the driving means is operable to drive the feed roller means through successive time intervals to advance successive increments of yarn with the control means being operable to vary the number of said time intervals per cycle during which increments of yarn are fed to form different loops.

The aforestated difficulties in the art are also alleviated by the utilization of a novel method of yarn delivery encompassed by this invention. In this method a feeding force is applied to individual yarns through successive time intervals to advance successive increments of yarn. The method further includes the step of selectively varying the number of said time intervals during a tufting cycle during which different lengths of yarn are fed to some different ones of said tufted loops to thereby vary the relative lengths of the different loops in accordance with a predetermined pattern. Preferably such increments of yarn are of a uniform length to facilitate the utilization of pattern control means for providing widely varied tufted patterns.

Numerous other features and advantages of the present invention will be apparent from consideration of the specification, taken in conjunction with the accompanying drawings.

Figure 2:
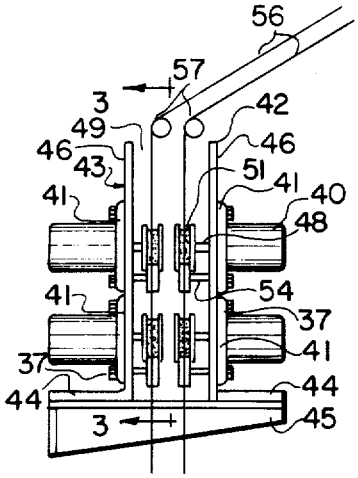
FIG. 2 is an enlarged view of the embodiment of the delivery means shown in FIG. 1.

DESCRIPTION OF THE PREFERRED EMBODIMENTS:

These figures and the following detailed description disclose a specific embodiment of the invention but the invention is not limited to the details disclosed since it may be embodied in other equivalent forms.

The invention in yarn length control disclosed herein is particularly well adapted to controlling the delivery of yarn to the plurality of needles used in the production of tufted fabrics. Moreover, it is particularly well adapted to the production of tufted fabrics by tufting machines using a plurality of hollow needles which pierce a backing material and through which yarn is fed by the flow of a fluid such as air. This is because the control of the length of yarn delivered to each hollow needle effectively controls the yarn fed through or along a backing material by the hollow needle.

Accordingly, the invention is disclosed herein in terms of an embodiment of the invention for delivering yarn to the plurality of hollow needles of a tufting machine. However, it will be understood that the embodiment may be used in the production of other products and that other embodiments of the invention may be used in the tufting art as well as in other arts.

The tufting machine 10 with which the invention is disclosed herein is a conventional tufting machine comprising a base portion 11 and an upper housing 12 extending from one side of the tufting machine 10 to the other. Uprights 13 located at the ends of the tufting machine 10 support the upper housing 12 in spaced relation to the base portion 11. Within and extending the length of the upper housing 12 is a rotatable shaft 14 having fixedly positioned along its length a plurality of eccentrically mounted cylindrical members 15.

Each cylindrical member 15 is inserted into the upper end 16 of a bearing member 17 which at its lower end is pivotally connected at 18 to the upper end of a push rod 19. Each push rod 19 is mounted for vertical sliding movement in a bearing sleeve 20 carried by the upper housing 12 and each push rod 19 has its lower end fixedly connected to a needle bar 21.

The needle bar 21 has a plurality of hollow needles 22 distributed along its length in a plurality of rows and each hollow needle 22 extends through an opening 23 in a presser foot 24 carried by the lower end of a bracket 25 attached to the upper housing 12. The base portion 11 carries a needle plate 26 which is arranged in conventional manner to support a backing material 27 as it passes from feed rolls 28 to take-up rolls 29 beneath the presser foot 24. It will now be understood that rotation of the shaft 14 by any suitable power means (not shown) will cause reciprocating motion of the needle bar 21 which in turn causes the hollow needles 22 to pass back and forth through the backing material 27.

In the tufting machine 10 chosen to illustrate an embodiment of the invention disclosed herein, the hollow needles 22 are of a conventional type through which yarn is fed by fluid from within the needle bar 21 flowing within the hollow needles 22. Fluid is provided the needle bar 21 through a tube 31 from a source of fluid under pressure (not shown). It will now be understood that the tufting machine 10 disclosed herein is of conventional design and that with the rotation of the shaft 14 and the feeding of the backing material 27 from some conventional source (not shown) across the tufting machine 10 by the feed rolls 28 and the take-up rolls 29, a plurality of loops of yarn 33 will be formed, with the forming and the size of each loop of yarn 33 by a hollow needle 22 being determined by the length of yarn 56 delivered to each hollow needle 22 during a stitching cycle. It is to the delivery of lengths of yarn 56 to each of the plurality of hollow needles 22 that that embodiment of the invention disclosed herein is directed.

Whether the invention is used with a tufting machine 10 such as that described above or to meet other requirements for the delivery of yarn, the invention can be best understood in terms of a yarn delivery apparatus comprising a delivery means which when operative delivers yarn to a yarn feed means such as a hollow needle 22 at a substantially constant delivery rate, and a control means for controlling the operation of the delivery means. The delivery means and control means can in turn be best understood by considering each separately.

The delivery means of the yarn delivery apparatus disclosed herein comprises a plurality of separate driving means illustrated as motors 40 positioned adjacent the upper housing 12. The motors 40 each have an integral flange 41 at one end by which each motor 40 is attached to an angle member 42 or an angle member 43 by bolts 37. The horizontal portions 44 of the angle members 42 and 43 are attached to a support bracket 45 extending from the upper housing 12 and the vertical portions 46 of the angle members 42 and 43 extend parallel to each other in spaced relationship to provide a yarn delivery area 49.

The delivery means further includes yarn advancing means illustrated as a feed roller means at fixed feeding stations along respective yarns for applying a frictional feeding force to respective yarns 56. The feed roller means illustrated herein includes a plurality of roller assemblies each having a cylindrical delivery roll 50 preferably defining an abrasive drive surface 51, to provide increased frictional engagement with the yarn, in cooperative relation with an idler roller 53. The feed roller means is rotated by said driving means through successive time intervals within individual cycles of movement of the tufting needles 22 to move successive increments of yarn past said feed roll 50. Thus, by varying the number of successive time intervals during which the yarn is fed, varying lengths of yarn may be made available to the tufting needles for the formation of tufted loops of various lengths.

The drive shaft 48 of each moter 40 extends through the angle member 42 or 43 on which the motor 40 is mounted into the yarn delivery area 49, and mounted on each drive shaft 48 within the yarn delivery area 49 is the cylindrical delivery roll 50. The cylindrical surface 51 of each delivery roll 50 is recessed between two flanges 52 and is abrasive or rough in character. Inserted between the flanges 52 of each delivery roll 50 is the periphery of an idler roller 53 mounted for free rotational movement on one of a plurality of shafts 54 extending between the angle members 42 and 43.

Figure 3:
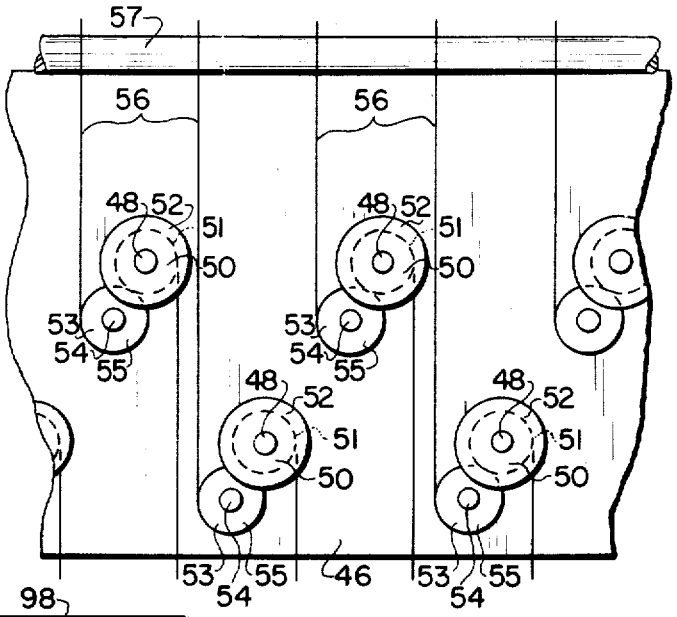
FIG. 3 is a sectional view of that embodiment of the delivery means shown in FIG. 2 taken in line 3—3 in FIG. 2.

The idler rollers 53 are of rubber or similar material and are positioned so that their peripheral surfaces 55 engage the cylindrical surfaces 51 of the delivery rolls 50. Thus, each idler roller 53 will serve to press a length of yarn 56 against the cylindrical surface 51 of a delivery roll 50 as the length of yarn 56 passes from a creel or other yarn source (not shown) to a hollow needle 22. One manner in which a length of yarn 56 may pass from a yarn source to a hollow needle 22 is best shown in FIG. 3 where it will be seen that the length of yarn 56 passes from a yarn source over guide bars 57 positioned above the yarn delivery area 49, thence to and beneath an idler roller 53, thence between the idler roller 53 and a delivery roll 50, thence over the delivery roll 50 and finally downwardly through a yarn guide board 47 to a hollow needle 22. As each length of yarn 56 passes between the idler roller 53 and the delivery roll 50, the length of yarn 56 is firmly gripped between the idler roller 53 and the delivery roll 50 and it will not be understood that lengths of yarn 56 are delivered to the plurality of hollow needles 22 only by rotation of the delivery rolls 50.

The motors 40 are conventional pulse responsive motors of known type in that the drive shaft 48 of each motor 40 rotates a predetermined amount in response to each electrical pulse to the motor. Thus, the rotation of the drive shaft 48 of each motor 40 and of a delivery roll 50 mounted thereon is a function of the number of electrical pulses to the motor 40, and for a particular circumference of the delivery roll 50, each pulse to the motor 40 will deliver a particular length of yarn 56 from the delivery area 49 to a hollow needle 22.

In that embodiment of the delivery means disclosed herein, all of the delivery rolls 50 have the same circumference and each delivery roll 50 delivers lengths of yarn 56 to a particular hollow needle 22. Thus, it will be understood that the length of yarn 56 delivered to a particular hollow needle 22 is controlled by selectively varying the number of electrical pulses to the motor 40 driving the delivery roll 50 which delivers the length of yarn 56 to that particular hollow needle 22 and that the lengths of yarn 56 being delivered during a single stitching cycle to the plurality of hollow needles 22 are controlled from one hollow needle 22 to another by selectively varying the number of electrical pulses going to each of the plurality of motors 40 during the stitching cycle. More importantly, it will be understood that by selectively controlling the number and the time of occurrence of electrical pulses to the plurality of motors 40, the lengths of yarn 56 delivered to the hollow needles 22 are controlled to provide loops of yarn 33 which have a wide variety of predetermined heights and which are formed during periods beginning at a wide variety of predetermined points during the period of time required for a stitching cycle.

Figure 1:
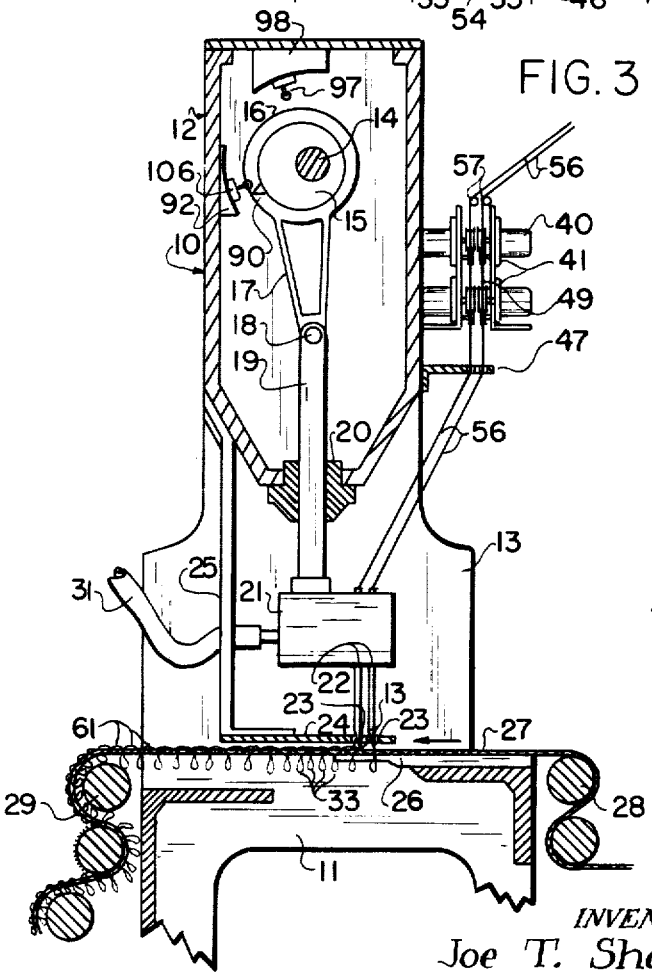
FIG. 1 is a schematic presentation of a tufting machine having an embodiment of the delivery means mounted thereon.

Thus, with the backing material 27 moving at a constant rate to the left as represented in FIG. 1 and with the circumferences of the delivery rolls 50 being selected so that the rotational movement of each delivery roll 50 in response to a single electrical pulse to a motor 40 delivers that length of yarn 56 required for a back stitch 61, simultaneous single pulses to all of the motors 40 cause those lengths of yarn 56 required for back stitches 61 to be delivered simultaneously to all of the hollow needles 22. When these simultaneous electrical pulses are provided at that point in the stitching cycle at which it is desired for back stitches 61 to be formed, the back stitches 61 will be formed at this point and only at this point.

Similarly, simultaneously initiated groups of electrical pulses to the motors 40, subsequent or prior to the pulses for the back stitches 61 in a stitching cycle cause lengths of yarn 56 to be delivered to the hollow needles 22 for forming loops of yarn 33 at that point in a stitching cycle at which it is desired to form the loops of yarn 33. The actual length of yarn 56 delivered to each hollow needle 22 by a motor 40 and in each loop of yarn 33 is dependent upon the number of pulses in the group of pulses to the motor 40 and it will be understood that the motors 40 may be pulsed for varying intervals of time throughout and at any time during that portion of a stitching cycle which is subsequent to the heels 13a of the hollow needles 22 pressing the ends of the back stitches 61 against the backing material 27 as the hollow needles 22 initially penetrate the backing material 27 and which is prior to the hollow needles 22 clearing the backing material 27 upon their subsequent withdrawal from the backing material 27. Moreover, it will be understood that during any particular stitching cycle, the pulses to a motor 40 may be in successive groups and may overlap in time of occurrence the pulses to another motor 40.

Since the motors 40 rotate at a substantially constant average rotational speed while rotating in response to electrical pulses, it will also be understood that a length of yarn 56 required for a loop of yarn 33 of relatively low height is delivered to a hollow needle 22 during a short interval of time and that a length of yarn 56 required for a loop of yarn 33 of greater height is delivered to a hollow needle 22 during a greater interval of time which is generally initiated at the same point in a stitching cycle as the short interval of time so that the intervals of time are overlapping. Thus, the lengths of yarn 56 required for loops of yarn 33 of various heights are all delivered to the hollow needles 22 at a substantially constant yarn delivery rate but for intervals of time of different duration during a stitching cycle, the duration of the interval during which a length of yarn 56 is delivered to a particular hollow needle 22 being dependent upon the number of pulses to the motor 40 delivering lengths of yarn 56 to that particular hollow needle 22.

Since the delivery of the lengths of yarn 56 required for back stitches 61 is always initiated at the same predetermined point in the stitching cycle of the tufting machine 10, it will be understood that the back stitches 61 formed by all hollow needles 22 during a stitching cycle and by all hollow needles 22 during successive stitching cycles are always substantially uniform. It will also be understood that by delivering to a hollow needle 22 during a stitching cycle that length of yarn 56 required to form a float on the back of the backing material 27 and by properly relating delivery of this length of yarn 56 to the position of the hollow needle 22, a length of yarn 56 is provided for the forming of a float at exactly that point in the stitching cycle at which it is required rather than throughout the entire stitching cycle as in the prior art.

Similarly, it will be understood that since the delivery of the lengths of yarn 56 required to form loops of yarn 33 is initiated to all hollow needles 22 at a particular point in a stitching cycle and since the delivery of each length of yarn 56 is terminated at a particular point in the stitching cycle depending upon the height of the loop of yarn 33 to be formed from the length of yarn 56, each loop of yarn 33 is formed by a particular length of yarn 56 which is separate and distinct from previous and other lengths of yarn 56 for back stitches 61 and other loops of yarn 33. Thus, the height of each loop of yarn 33 is closely controlled and is entirely dependent upon the length of yarn 56 delivered to a particular hollow needle 22 during a stitching cycle.

However, it should be realized that lengths of yarn 56 for back stitches 61 and lengths of yarn 56 for loops of yarn 33 may be delivered as combined lengths of yarn 56 to the hollow needles 22 in conventional manner by eliminating any pause in the electrical pulses to the motors 40 required for separate delivery of lengths of yarn 56 for back stitches 61 and lengths of yarn 56 for loops of yarn 33. Under these circumstances, back stitches 61 and loops of yarn 33 are differentiated as in the prior art by the motion of the hollow needles 22 through the backing material 27, and the back stitches 61 can be formed either prior or subsequent to the loops of yarn 33. When the invention is used in this manner, the delivery of the lengths of yarn 56 is nevertheless initiated and terminated at predetermined points in a stitching cycle which accurately determine the length of each length of yarn 56 and which may be readily varied. Thus, the invention still provides a control of the heights of the loops of yarn 33 not possible in the prior art.

From the foregoing, it will be seen that the delivery of a length of yarn 56 to a hollow needle 22 at a constant delivery rate during one or more successive time periods of varying duration during a stitching cycle provides a highly versatile means for delivering a length of yarn 56 to a hollow needle 22 or similar device. For example, if a motor 40 driving a delivery roll 50 is pulsed when a length of yarn 56 for a back stitch 61 is required a greater number of times than is necessary to provide a length of yarn 56 for a back stitch 61, and, in addition is pulsed at another point in the stitching cycle to provide a length of yarn 56 for a loop of yarn 33 as described above, loops of yarn 33 are formed on both sides of the backing material 27 and a two-sided tufted fabric is produced. Other arrangements of pulses to the motors 40 during a stitching cycle or during successive stitching cycles will now be apparent to those skilled in the art who will understand the invention provides for an almost infinite variety of tufted fabric patterns.

Figure 4:
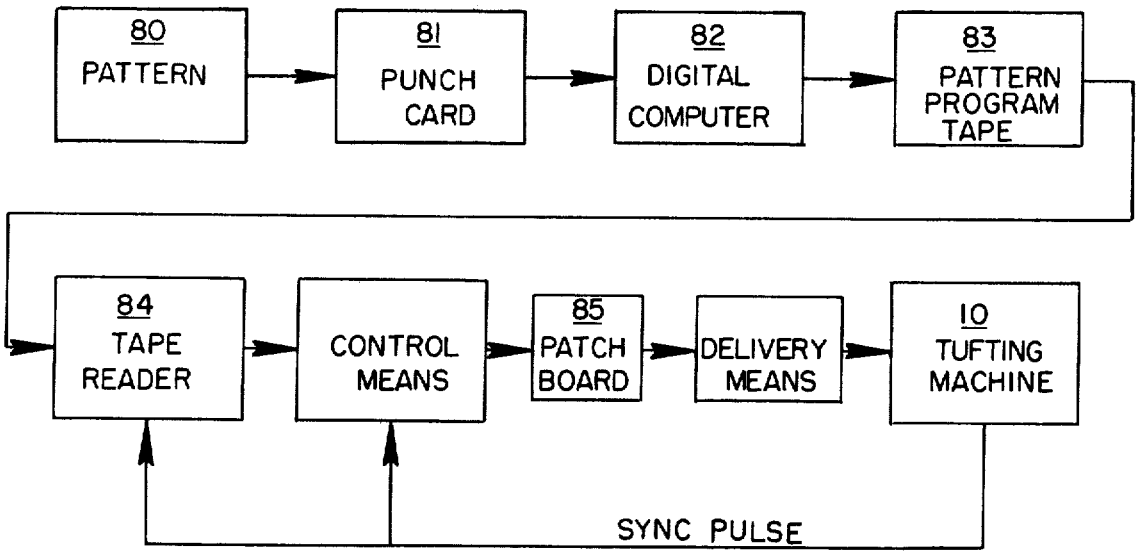
FIG. 4 is a block diagram of an embodiment of the yarn delivery apparatus with a tufting machine and patchboard and with the prepraration of a tufted fabric pattern for input to the control means represented.

The control means of the yarn delivery apparatus disclosed herein is for controlling the operation of the delivery means disclosed above and can most easily be understood in terms of the block diagram shown in FIG. 4 which shows the yarn delivery apparatus and includes not only the control means and the delivery means but also a tufting machine 10 and means for providing that input to the control means required for the production by the tufting machine 10 of a tufted fabric pattern.

The control means regulates the drive means to selectively vary the number of time intervals per tufting cycle during which successive increments of yarn preferably uniform in length, are continuously or intermittently fed to form different loops to thereby vary the number of yarn increments fed to said different loops to vary the relative lengths of said different loops in accordance with a predetermined pattern. Thus, the control means varies the duration of yarn advancement in successive cycles to advance yarn lengths varied in accordance with a predetermined pattern.

Preferably, the control means is comprised of means for storing coded data, such as digital data, corresponding to said predetermined pattern and electrical means to convert the coded data into code related electrical signals. The drive means is responsive to such electrical signals to feed varying numbers of yarn increments. Where the converting means converts said coded data to groups of electrical pulses, the number of pulses being code related, a drive means is provided which is responsive to the number of pulses received to supply a proportional number of yarn increments.

The converting means may be a binary to analogue converter means for conversion of coded binary characters to discrete groups of electrical pulses. Preferably, the binary to analogue converter includes a reading means for transfer of data from such storage or support means as a magnetic tape, a binary counting means for issuance of a signal proportional to the binary character read from the storage means, pulse generating means operatively coupled to a yarn delivery means by a pulse output line and gating means in said output line responsive to the signal from the counting means for opening and closing said output line to selectively permit and prevent respectively the transfer of pulses to the drive means.

In addition, the converting means includes means for controlling the reading and counting cycles whereby the transmission of said pulses will occur at selected intervals so that the yarn is delivered in timed sequence to the movement of the needle means. Preferably, cooperative means are connected to the movable needle means and the reading and counting control means for regulating the reading and counting cycles responsively to the position of the needle means. In this manner, reading, counting and pulse delivery may occur at any time or times in each cyclic movement of the needle means. Thus, separate yarn lengths may be delivered at different times for formation of loops and back stitches.

From FIG. 4, it will be seen that information defining a tufted fabric pattern 80 in terms of loops of yarn 33 of various heights is converted into punchcards 81 for input to a digital computer 82 which is programmed for the preparation of a data storage means disclosed as a pattern program tape 83. With the control means disclosed herein, the pattern program tape 83 contains a series of binary coded characters, each binary coded character being equivalent to a decimal number representing the relative height of a particular loop of yarn 33 in that group of loops of yarn 33 formed by the hollow needles 22 during a single stitching cycle. Each series of binary coded characters is followed by a similar series of binary coded characters for each group of loops of yarn 33 required to define the complete pattern 80 in a predetermined number of successive stitching cycles. Thus, there is a plurality of series of binary coded characters in sequence on the pattern program tape 83 corresponding to the plurality of stitching cycles required for a particular complete pattern 80.

The pattern program tape 83 is a conventional magnetic tape having the binary coded characters magnetically recorded thereon and it will be understood that the pattern program tape 83 also contains validating and other information which will become apparent when the control means is described in detail below. More importantly, it will be understood that the preparation of the pattern program tape 83 is conventional and within the skill of those skilled in the art. Once the control means is understood it will also be understood that the input to the control means may be from other than a pattern program tape 83.

In that embodiment of the invention disclosed herein, the control means includes a tape reader 84 to provide an electrical input from the pattern program tape 83 to a means for converting said coded data into code related electrical signals illustrated as a binary to analogue converter and with a patchboard 85 to distribute the output of the control means to the motors 40. The tape reader 84 and the patch board 85 are conventional and will be only briefly described to that extent necessary for a full understanding of the control means.

Figure 5:
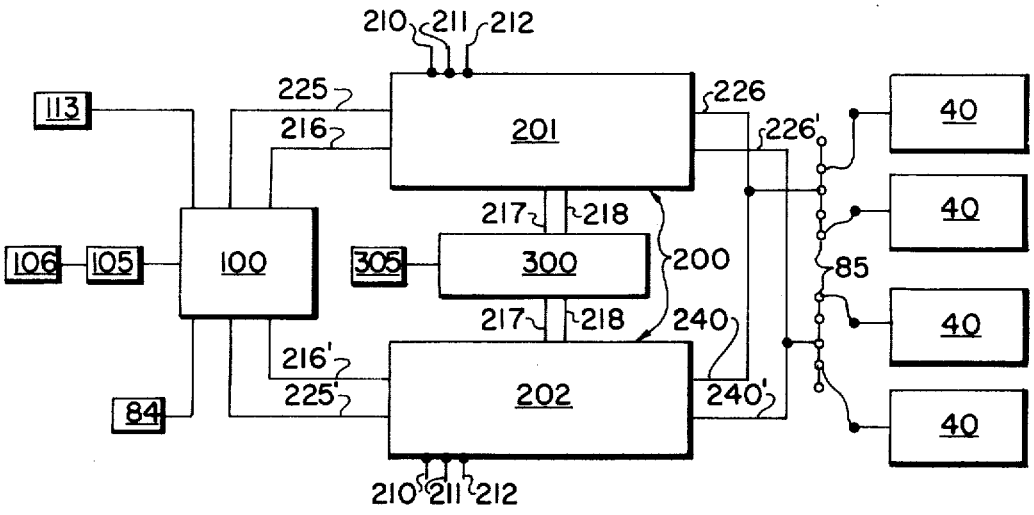
FIG. 5 is a block diagram of an embodiment of the yarn delivery apparatus.

The control means is generally shown in FIG. 5 where it will be seen that the control means further includes a machine responsive portion 100, an output portion 200, and a selector portion 300. The output portion 200 includes two convertor means illustrated as binary to analogue convertors or pulse generating units 201 and 202 which are identical to each other. Thus, only one pulse generating unit 201 is shown in detail in FIG. 7 and from FIG. 7, it will be seen that the pulse generating unit 201 comprises a plurality of bi-stable element groups 203 and 204. The number of bi-stable elements 205, 206 and 207 in the bi-stable element group 203 and the number of bi-stable elements 205', 206' and 207' in the bi-stable element group 204 is dependent upon the number of binary digits in the binary coded characters used to represent the various heights of loops of yarn 33 in the pattern 80, and the number of bi-stable element groups 203 ad 204 is dependent upon the number of different heights of the loops of yarn 33 which it is desired to provide simultaneously during each stitching cycle of the tufting machine 10.

Figure 7:
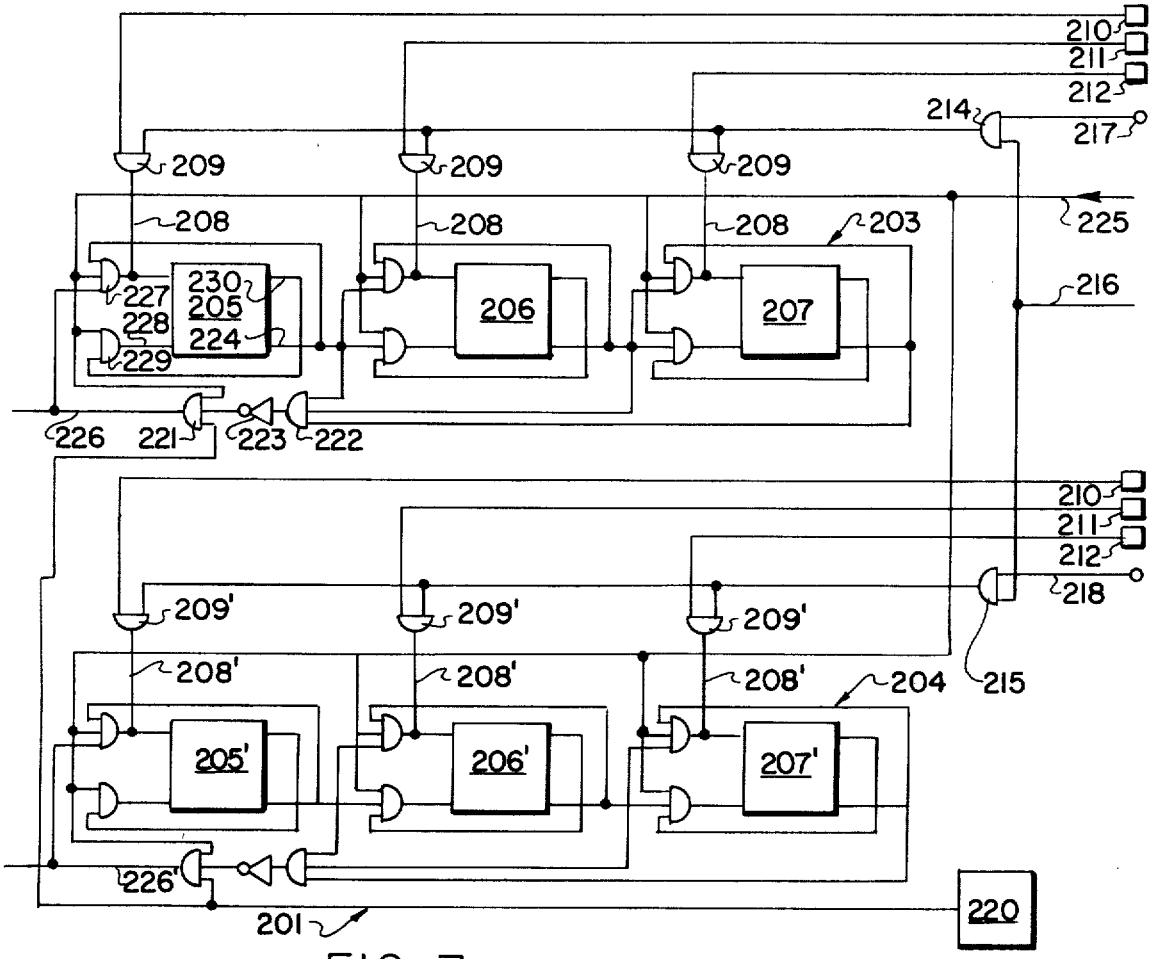
FIG. 7 is a schematic diagram of one of the pulse generating units in the output portion of the control means.

Thus, the pulse generating unit 201 shown in FIG. 7 is adapted for binary coded characters which contain three binary digits corresponding to decimal numbers and relative heights of loops of yarn 33 ranging from zero to seven and for two different heights of loops of yarn 33 per stitching cycle of the tufting machine 10. However, it should be understood that the number of bi-stable elements 205, 206, 207, 205', 206' and 207' in the bistable element groups 203 and 204 may be increased to permit the binary representation of a larger range of decimal numbers and relative heights of loops of yarn 33, and that the number of bi-stable element groups 203 and 204 may be increased to provide simultaneously for more than two different heights of loops of yarn 33 during each stitching cycle.

One input terminal 208 of each of the three bi-stable elements 205, 206 and 207 in the bi-stable element group 203 is connected through a two-input and gate 209 to a reading head 210, 211 or 212 of the tape reader 84. Similarly, one input terminal 208' of each of the bi-stable elements 205', 206' and 207' in the bi-stable element group 204 is connected through a two-input and gate 209' to the reading head 210, 211 or 212. The arrangement is such that an electrical pulse caused by a binary digit read by the reading head 210 is simultaneously fed to a two-input and gate 209 connected to the input terminal 208 of the bi-stable element 205 and to a two-input and gate 209' connected to the input terminal 208' of the bi-stable element 205'. Similarly, an electrical pulse caused by a binary digit read by the reading head 211 is simultaneously fed to a two-input and gate 209 connected to input terminal 208 of the bi-stable element 206 and to a two-input and gate 209' connected to the input terminal 208' of the bi-stable element 206' , and an electrical pulse caused by a binary digit read by the reading head 212 is simultaneously fed to a two-input and gate 209 connected to the input terminal 208 of the bi-stable element 207 and to a two-input and gate 209' connected to the input terminal 208' of the bi-stable element 207'. Thus, it will be understood that each binary digit in successive binary coded characters on the pattern program tape 83 causes an electrical pulse to be fed or not fed to a two-input and gate 209 connected to a bi-stable element 205, 206 or 207 in the bi-stable element group 203 and simultaneously to a corresponding two-input and gate 209' connected to a bi-stable element 205', 206' or 207' in the bi-stable element group 204. Whether an electrical pulse is or is not fed to a two-input and gate 209 or 209' is dependent in conventional manner upon the nature of the binary digit.

It is by selectively providing a second input to the two-input and gates 209 and 209' that the electrical pulses caused by binary digits in successive binary coded characters alternately pass through the two-input and gates 209 into the bi-stable elements 205, 206 and 207 and through the two-input and gates 209' into the bi-stable elements 205', 206' and 207'. This selective second input to the two-input and gates 209 and 209' is provided through the two-input and gates 214 and 215 which have a common input at 216 from the machine responsive portion 100. The second input to two-input and gates 214 and 215 is provided at 217 and 218 respectively from the selector portion 300.

Thus, if the pulse generating unit 201 has an input at 216 from the machine responsive portion 100 and is provided with inputs at 217 and 218 in sequence from the selector portion 300, the two inputs required at the two-input gates 214 and 215 are provided in sequence to the two-input and gates 214 and 215. As will be understood from the description of the machine responsive portion 100 and the selector portion 300 below, these sequential inputs at the two-input and gates 214 and 215 are coordinated with the passage of successive binary coded characters on the pattern program tape 83 beneath the reading heads 210, 211, and 212 so that electrical pulses caused by one binary coded character correspond in time at the two-input and gates 209 with a second input from the two-input and gate 214 caused by the input at 217 and the electrical pulses caused by the next binary coded character correspond in time at the two-input and gates 209' with a second input from the two-input and gate 215 caused by the input at 218.

With all of the bi-stable elements 205, 206, 207, 205', 206' and 207' in the same initial stable state and responsive to an input at the input terminals 208 and 208', the presence of an input at a two-input and gate 209 and 209' from both a reading head 210, 211 or 212 and a two-input and gate 214 or 215 causes the bi-stable element to which the two-input and gate 209 or 209' is connected to change from its initial stable state to its alternate stable state. Similarly, the absence of an input from a reading head 210, 211 or 212 at a two-input and gate 209 or 209' in the presence of an input from a two-input and gate 214 or 215 will not influence a bistable element.

Thus, the stable state conditions of the bi-stable elements 205, 206 and 207 in the bi-stable element group 203 subsequent to simultaneous inputs at 216 and 217 and from reading heads 210, 211 and 212 are dependent upon the binary coded character which was read by the reading heads 210, 211 and 212 simultaneously with the inputs at 216 and 217. Similarly, the stable state conditions of the bi-stable elments 205', 206' and 207' in the bi-stable element group 204 subsequent to simultaneous inputs at 216 and 218 and from reading heads 210, 211 and 212 are dependent upon the binary coded character which was read by the reading heads 210, 211 and 212 simultaneously with the inputs at 216 and 218.

For example, a binary coded character of 101 causes the bi-stable elements 205, 206 and 207 to be in their alternate, initial, and alternate stable states respectively. It is these and similar changes in the stable states of the bi-stable elements 205, 206, 207 and similar changes in the bi-stable elements 205', 206', and 207' which are used in the bi-stable element groups 203 and 204 to provide inputs representative of a particular height of a loop of yarn 33. This will be understood by considering the bistable element group 203 in further detail.

Each pulse generating unit 201 and 202 includes a pulse generator 220 which continuously provides a pulsing input to three-input and gate 221 in the bi-stable element group 203. A second input to this three-input and gate 221 is provided from a three-input and gate 222 through an inverter 223 which serves to provide an input at the three-input and gate 221 only when the three inputs to the three-input and gate 222 are dissimilar. The three inputs to the three-input and gate 222 are from the initial stable output terminals 224 of the three bi-stable elements 205, 206 and 207 in the bi-stable element group 203. Thus, when the bi-stable elements 205, 206 and 207 are placed in different stable states in response to the binary digits in a binary coded character, there is a second input at the three-input and gate 221 to supplement the continuous input from the pulse generator 220. The third input required at the three-input and gate 221 is provided at 225 from the machine responsive portion 100. The machine responsive portion 100 provides an input at 225 alternately with the input at 216 and with the input from the three-input and gate 222, this input at 225 to the three-input and gate 221 causes a pulsing output at 226 from the three-input and gate 221 in response to pulses from the pulse generator 220.

Each input terminal 208 of the bi-stable elements 205, 206 and 207 is connected to a three-input and gate 227 and a second input terminal 228 of each bi-stable element 205, 206 and 207 is connected to a three-input and gate 229. One input to each of the three-input and gates 227 is from the output terminal 224 corresponding to the other input terminal 228 of the same bi-stable element 205, 206 and 207. Similarly, one input to each of the three-input gates 229 is from the output terminal 230 corresponding to the other input terminal 208 of the same bi-stable element 205, 206 and 207. A second input to all of the three-input and gates 227 and 229 is provided by the input at 225 from the machine responsive portion 100 and a third input to the three-input and gates 227 and 229 connected to the input terminals 208 and 228 of the bi-stable element 205 is provided by the output of the three-input and gate 221. Thus, with an input at 225 and a pulsing output at the three-input and gate 221, the bi-stable element 205 changes its stable state in response to each pulse from the pulse generator 220.

The output at the output terminal 224 of the bi-stable element 205 is not only to the three-input and gate 222 but also to the three-input and gates 227 and 229 connected to the input terminals 208 and 228 of the bi-stable element 206. and at these three-input and gates 227 and 229 provides a third input when there is an input at 225. As a result, the bi-stable element 206 changes its stable state in response to the output at the output terminal 224 of the bi-stable element 205. Similarly, the output at the output terminal 224 of the bi-stable element 206 is not only to the three-input and gate 222 but also to the three input and gates 227 and 229 connected to the input terminals 208 and 228 of the bi-stable element 207 where it causes a change in the stable state of the bi-stable element 207 in response to the output at the output terminal 224 of the bi-stable element 206.

Those familiar with the art will understand this arrangement of bi-stable elements 205, 206 and 207 as an arrangement responsive to the pulsing output at the three-input and gate 221 and in which all of the bi-stable elements 205, 206 and 207 are in their initial stable states only after that number of electrical pulses from the pulse generator 220 which correspond decimally to the binary coded character represented by their stable states prior to the electrical pulses. It will be understood that when all of the bi-stable elements 205, 206 and 207 are placed in their initial stable states, the input to the three-input and gate 221 from the three-input and gate 222 is removed and there is no further pulsing output at the three-input and gate 221 to the bi-stable element group 205 and at the output 226. Thus, the number of electrical pulses at the output 226 is the number of pulses corresponding to a binary coded character on the pattern program tape 83 and it is in this manner that a binary coded character on the pattern program tape 83 becomes a particular number of pulses at the output 226.

One input to the motors 40 is the output 226 and a second and simultaneously provided input is the output at 226' from the bi-stable element group 204 which is responsive to the same inputs at 216 and 225 as the bi-stable element group 203. The pulse generating unit 202 is alternately responsive with the pulse generating unit 201 to the inputs at 261' and 225' from the machine responsive portion 100 and serves to provide simultaneous outputs 240 and 240' which alternate with the simultaneous outputs 226 and 226'. These outputs 226, 226', 240 and 240' serve to rotate the motors 40 by amounts determined by the number of pulses in each particular output and since each output 226, 226', 240 and 240' corresponds to a binary coded character on the pattern program tape 83 which in turn corresponds to a loop of yarn 33 of a particular height, the motors 40 deliver particular lengths of yarn 56 to the hollow needles 22 as the motors 40 rotate.

Figure 9:
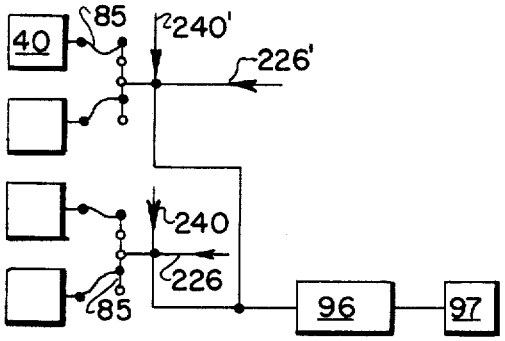

The outputs 226, 226', and 240 and 240' may be connected directly to the motors 40 or may be connected to the input terminals of the patchboard 85. The patchboard 85 is of conventional type and as indicated in FIGS. 5 and 9, each input to an input terminal 88 may be patched to a plurality of output terminals to provide a plurality of outputs to the motors 40.

The patchboard 85 is well adapted to situations in which the pattern of a tufted fabric is symmetrical about a longitudinal centerline of the fabric since the same height for a loop of yarn 33 is always required simultaneously on opposite sides of the centerline and since the motor 40 delivering each loop of yarn 33 can be controlled from a single binary coded character on the pattern program tape 83 by patching in conventional manner. The patchboard 85 is also well adapted to situations in which the motors 40 are delivering lengths of yarn 56 to hollow needles 22 on a plurality of tufting machines 10. This is because the patchboard 85 permits a single binary coded character to control the length of yarn 56 delivered to a hollow needle 22 on each of the plurality of tufting machines 10. Other uses of the patchboard 85 will be immediately obvious to those skilled in the art.

Figure 6:
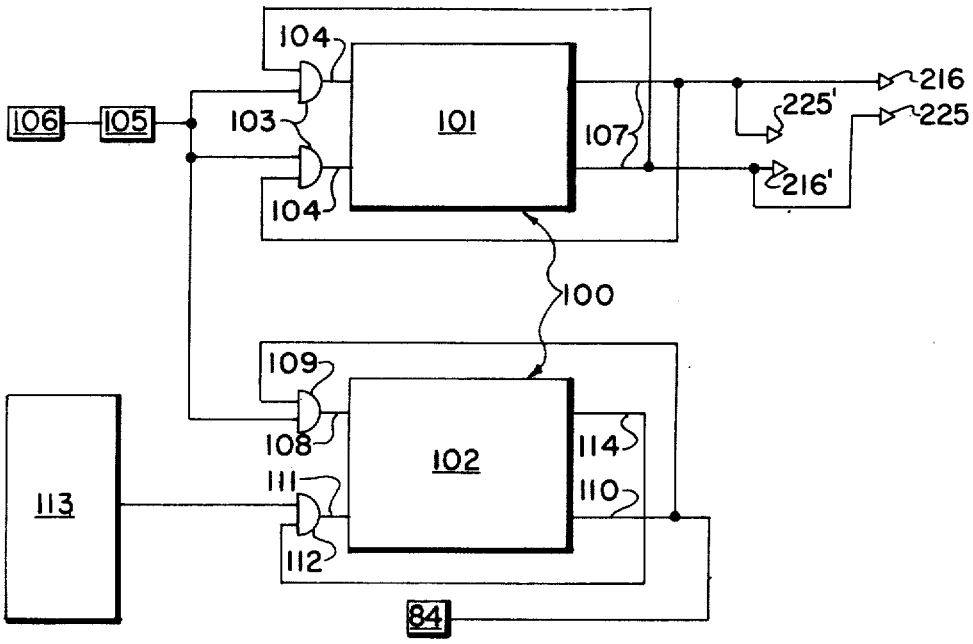
FIG. 6 is a schematic diagram of the machine responsive portion of the control means.

The machine responsive portion 100 of the control means which provides the inputs at 216 and 225 for the pulse generating unit 201 and alternately at 216' and 225' for the pulse generating unit 202 is best seen in FIG. 6. From FIG. 6, it will be seen that the machine responsive portion 100 comprises two bi-stable elements 101 and 102 and that the bi-stable element 101 has a two-input and gate 103 connected to each of its input terminals 104. One input to both of the two-input and gates 103 is through a shaping element 105 from a micorswitch 106. The other input to each of the two-input and gates 103 connected to an input terminal 104 is from the output terminal 107 corresponding to the other input terminal 104.

One input terminal 108 of the bi-stable element 102 is connected to a two-input and gate 109 which has one input from the microswitch 106 through the shaping element 105 and a second input from the output terminal 110 corresponding to the other input terminal 111 of the bi-stable element 102. The input terminal 111 is connected to a two-input and gate 112 which has one input from a reading head 113 and a second input from the output terminal 114 corresponding to the input terminal 108.

It will now be understood by those skilled in the art that with this arrangement, the bi-stable element 101 changes its stable state each time the microswitch 106 operates and that an output is alternately provided at one and then the other of its output terminals 107. One output terminal 107 of the bi-stable element 101 provides the input 216 to the pulse generating unit 201 and the input 225' to the pulse generating unit 202 and the other output terminal 107 of the bi-stable element 101 provides the input 216' to the pulse generating unit 202 and the input 225 to the pulse generating unit 201.

Thus, it will be understood that the operation of the microswitch 106 serves to alternately enable one pulse generating unit 201 or 202 to receive binary coded characters from a pattern program tape 83 while the other pulse generating unit 201 or 202 is providing pulses to the motors 40 in accordance with previous binary coded characters. It will also be understood that the two pulse generating units 201 and 202 permit operation of the control means at maximum efficiency since one pulse generating unit 201 or 202 is receiving binary coded characters while the other pulse generating unit 201 or 202 is pulsing the motors 40.

The microswitch 106 is mounted in the upper housing 12 where it is engaged by a pawl 90 extending from a cylindrical member 15 once during each stitching cycle of the tufting machine 10. In FIG. 1 the microswitch 106 is positioned to be engaged by the pawl 90 at that point in each stitching cycle at which it is desired for the motors 40 to deliver lengths of yarn 56 to the hollow needles 22 for the forming of loops of yarn 33. It will be understood that the motors 40 deliver lengths of yarn 56 to the hollow needles 22 at this point because the closing of the microswitch 106 causes an input at 225 to pulse generating unit 201 or an input at 225' to the pulse generating unit 202. An input at either 225 or 225' causes electrical pulses to the motors 40 as described above.

It will also be understood that the point in the stitching cycle at which the motors 40 deliver lengths of yarn 56 to the hollow needles 22 may be varied by simply varying the point in the stitching cycle at which the microswitch 106 is engaged by the pawl 90. This can be most conveniently accomplished by slidably mounting the microswitch 106 on a block 92 within the upper housing 12 so that the rotational position of the shaft 14 at which the microswitch 106 is engaged by the pawl 90 is variable by slidable movement of the microswitch 106 along the block 92.

The reading head 113 which provides one input to the two-input and gate 112 is at the tape reader 84 and provides an electrical pulse to the two-input and gate 112 each time it reads a character on the magnetic tape which corresponds in position on the magnetic tape with the last binary coded character in the last series of binary coded characters in a plurality of successive series of binary coded characters defining the heights of the loops of yarn 33 in a complete pattern for a tufted fabric. Thus, there is an input from the tape reader 84 to the two-input and gate 112 each time the delivery by the motors 40 of the lengths of yarn 56 required for a complete pattern of loops of yarn 33 is completed.

The output terminal 110 of the bi-stable element 102 corresponding to the input terminal 111 provides an input to the tape reader 84 which stops tape advance in the presence of the input and causes tape advance in the absence of the input. The initial stable state of the bi-stable element 102 is that which provides an output at its output terminal 110 and an input to the tape reader 84 and as a result, when the bi-stable element 102 is in its initial stable state the pattern program tape 83 is not being advanced by the tape reader 84.

The initial stable state output at the output terminal 110 of the bi-stable element 102 also provides one input to the two-input and gate 109 connected to the other input terminal 108 of the bi-stable element 102. Thus, upon initial starting of the tufting machine 10 and the initial closing of the microswitch 106, the second input to the two-input and gate 109 caused by the closing of the microswitch 106 changes the stable state of the bi-stable element 102 from its initial stable state to its alternate stable state. This removes the output at the output terminal 110 and the input to the tape reader 84. As a result, the pattern program tape 83 advances and will continue to advance until an input from the reading head 113 corresponding to the end of a complete pattern complements the input from the output terminal 114 of the bi-stable element 102 at the two-input and gate 112 and causes the bi-stable element 102 to change to its initial stable state.

Thus, it will be understood that upon initial starting of the tufting machine 10, the closing of the microswitch 106 causes the pattern program tape 83 to advance and that this advance continues until an input is provided to the bi-stable element 102 from the pattern program tape 83 to signify that the plurality of series of binary coded characters defining a complete pattern has passed the reading heads 210, 211 and 212. Restarting of the tufting machine 10 or its continued operation and the closing of the microswitch 106 will cause the further advance of the pattern program tape 83 so that a new pattern or the same pattern may pass the reading heads 210, 211 and 212.

Figure 8:
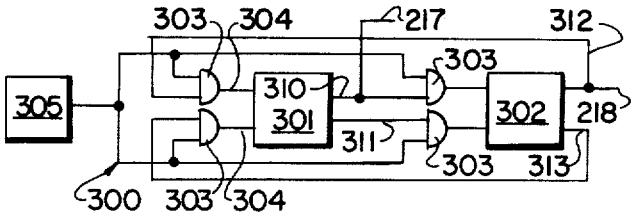
FIG. 8 is a schematic diagram of the selector portion of the control means; and, FIG. 9 is a schematic diagram of the yarn delivery means.

The selector portion 300 of the control means provides the inputs 217 and 218 by which the binary coded characters in a series of binary coded characters are passed to selected bi-stable element groups 203 and 204 in the pulse generating unit 201 and selected bi-stable element groups 203' and 204' in the pulse generating unit 202. From FIG. 8, it will be seen that the selector portion 300 comprises two bi-stable elements 301 and 302, each having a two-input and gate 303 connected to both of its input terminals 304. One input to all of the two-input and gates 303 is from a reading head 305 at the tape reader 84. This reading head 305 reads a timing character on the pattern program tape 83 which coincides with each binary coded character on the pattern program tape 83. Thus, there is a pulse input to every two-input and gate 303 in the selector portion 300 each time a binary coded character is read by the reading heads 210, 211 and 212.

The output terminals 310 and 311 of the bi-stable element 301 provide the second inputs to the two-input and gates 303 of the bi-stable element 302. Similarly, the output terminals 312 and 313 of the bi-stable element 302 provide the second inputs to the two-input and gates 303 of the bi-stable element 301. Thus, with each pulse input from the reading head 305 corresponding to a binary coded character, the bi-stable element 301 changes its stable state and the bi-stable element 302 changes its stable state. The input 217 to pulse generating units 201 and 202 is the output at output terminal 310 of the bi-stable element 301 and the input 218 to the pulse generating units 201 and 202 is the output at the output terminal 313 of the bi-stable element 302 at which there is an output in response to an input from the output terminal 311 of the bi-stable element 301.

Those skilled in the art will understand that this arrangement results in the inputs 217 and 218 occurring alternately in response to repeated inputs from the reading head 305 so that successive binary coded characters will pass to one and then the other bi-stable element group 203, 203′, 204, 204′ in the pulse generating units 201 and 202. Those skilled in the art will also recognize that the selector portion 300 may be expanded by the addition of bi-stable elements 301 and 302 and that the outputs 217 and 218 may be alternated with additional outputs in response to repeated inputs from the reading head 305. This permits embodiments of the control means disclosed herein having more than two bi-stable element groups in each pulse generating unit 201 and 202 so that the simultaneous delivery of lengths of yarn 56 of more than two different lengths to the motors 40 may be obtained. Moreover, it should again be emphasized that the number of binary digits in each binary coded character and the variation in number of pulses available for delivering various lengths of yarn 56 to the hollow needles 22 may be increased by simply adding additional bi-stable elements in each bi-stable element group 203, 203′, 204 and 204′.

The motors 40 may be pulsed with single pulse to deliver lengths of yarn 56 for back stitches 61 and may be separately pulsed to deliver lengths of yarn 56 for loops of yarn 33 of various heights by using a pattern program tape 83 having a suitable arrangement of binary coded characters. Such a pattern program tape 83 is well within the skill of those skilled in the art.

However, it has been found that the simultaneous pulsing of the motors 40 to provide a single pulse to all the motors 40 at a particular time during each stitching cycle so that the motors 40 will deliver lengths of yarn 56 for back stitches 61 is conveniently accomplished, as shown in FIG. 9, by directly and simultaneously pulsing all the motors 40 through a shaping element 96 from a microswitch 97 positioned to be engaged by the pawl 90 at that point in each stitching cycle at which it is desired for the motors 40 to deliver lengths of yarn 56 for back stitches 61. In FIG. 1 this microswitch 97 is positioned to be engaged by the pawl 90 as the hollow needles 22 move toward the backing material 27 at the start of each stitching cycle. However, as with the microswitch 106, the microswitch 97 is positioned for slidable movement along a bracket 98 so that the point in the stitching cycle at which it is engaged by the pawl 90 and at which the motors 40 deliver lengths of yarn 56 to the hollow needles 22 for back stitches 61 may be readily varied.

The invention in the controlled delivery of yarn from a yarn source to a feeding means disclosed herein will be understood from the foregoing detailed description of a yarn delivery apparatus adapted to provide a pattern of loops of yarn 33 of a plurality of heights for a tufted fabric. However, a brief description of the operation of this yarn delivery apparatus will serve to emphasize the adaptability of the invention to many other applications.

The basic method followed by the described apparatus includes the step of applying a feeding force to individual yarns for advancement of said yarns to make lengths of the respective yarns available to the needles for formation of loops and back stitches. In addition, the method includes the step of selectively varying the lengths of yarn advanced toward selective needles during the same tufting cycles as well as to the same needles during successive tufting cycles. More specifically, the feeding force may be applied to individual yarns to advance yarn increments of uniform length to the tufting needles with selective control of the feeding force to vary the number of said yarn increments advanced to selected needles during selected tufting cycles to vary the relative lengths of the pile loops formed thereby in accordance with a predetermined pattern.

This method also encompasses the application of said feeding force at a fixed point longitudinally of the path of movement of respective yarns for selectively variable time periods in successive tufting cycles to advance toward said needles selectively variable yarn lengths, proportional to said time periods to thereby form loops of different lengths. The application of the feeding force may be applied during selected time periods such that the length of yarn desired to form a loop of a predetermined length may be provided during a first time period in the tufting cycle with a second yarn length for providing a back stitch of a desired length provided during a second time period in the tufting cycle. Preferably, the back stitch length of yarn is provided after the tufting needles are withdrawn from the backing material. Of course, by varying the length of yarn provided for formation of the back stitch and controlling the speed of the backing material, the back stitch itself may provide a second loop on a side of the backing material thereby providing a tufting fabric with pile loops on both faces.

When used with a tufting machine 10 or in other applications, the yarn delivery apparatus is provided with an input comprising a plurality of binary characters to define the height of each loop of yarn 33. Each of these binary characters is fed to the output portion 200 of the control means which provides a pulse output in which the number of electrical pulses is the decimal equivalent of the binary coded character.

The delivery means of the yarn delivery apparatus is operatively responsive to the pulse output of the control means and delivers a length of yarn 33 proportional in length to the number of pulses in a pulse output in response to each pulse output from the control means. The control means provides a plurality of pulse outputs simultaneously and successively and as a result, various lengths of yarn 33 may be delivered simultaneously and in sequence.

However, the length of yarn 33 delivered is always defined by a binary coded character or by the input from another pulse source such as the microswitch 97 and is of a particular predetermined length. Thus, a pattern defined by loops of yarn 33 is readily produced from any other convenient source of binary coded characters arranged to define the pattern in terms of the heights of the loops of yarn 33.

Regardless of the source of the pattern input to the yarn delivery apparatus, each length of yarn 56 is delivered at a substantially constant yarn delivery rate at that time at which the length of yarn 56 is required. The result is substantially complete control over the tufting of a pattern and a pattern which has good definition, in which back stitches 61 and loops of yarn 33 are substantially uniform, and which may include floats and other previously difficult to achieve features. Moreover, the variety of patterns is almost limitless, since it is limited only by the variety of pulses to the motors 40 which those skilled in the art will recognize as being almost limitless.

It will also be recognized by those skilled in the art that a pattern may be changed almost instantly so that the down time of a tufting machine 10 characteristic of pattern changes in the prior art is substantially eliminated by the invention. Moreover, since each pattern may be simply a plurality of binary coded characters on tape 83 or a similar source of electrical input to the control means and since each length of yarn in a pattern may be individually controlled regardless of pattern or pattern repeat length and width, the invention permits an almost unlimited variety of patterns to be prepared and maintained at substantially less expense per pattern than has been general in the prior art.

In addition, since only the delivery means need be placed adjacent a tufting machine 10, the invention permits lengths of yarn 33 to be controlled from a delivery area 49 relatively close to the needles 22 and without restricting the use of the invention or the tufting machine because of space limitations. Moreover, the placing of the delivery area 49 relatively close to the needles 22 in combination with the substantially uniform tension in the lengths of yarn 56 provided by the constant yarn delivery rate substantially eliminates the slackening and tightening of the lengths of yarn 56 characteristic of the prior art. This, in turn, eliminates the bowstring vibrations in lengths of yarn, the friction between adjacent lengths of yarn, the frequent entanglement of adjacent lengths of yarn, and where fluid pressure is used to feed lengths of yarn, the variations in the amount of fluid required to feed the yarn which have been common in the prior art.

We claim:

1. In a tufting apparatus which includes means for moving a backing material along a path of travel, a plurality of yarn carrying tufting needles disposed transverse to said path, means for effecting relative cyclical movement between the needles and the backing material transversely of said path to cause penetration of the needles through and withdrawal of the needles from the backing material during each cycle, and means for feeding different controlled lengths of yarn to said needles to form in the backing material yarn loops of correspondingly different lengths extending from one side of the backing material and yarn back stitches extending between said loops on the other side of the backing material, the improvement in said controlled yarn feeding means which comprises:

feed roller means mounted at fixed feeding stations along the respective yarns for applying a frictional feeding force to individual yarns to move the yarns past said fixed stations, drive means to rotate said feed roller means through successive substantially uniform time intervals within individual cycles to move successive increments of yarn past said fixed stations, said drive means comprising a plurality of electrical pulse responsing stepping motors, and means to control the operation of said drive means to selectively vary the number of said time intervals per cycle during which increments of the yarn are fed to form different ones of said loops to thereby vary the number of increments which are fed to said different loops and thus vary the relative lengths of said different loops in accordance with a predetermined pattern, said control means including means for transmission to said stepping motors of selectively variable numbers of electrical pulses.

2. An apparatus as recited in claim 1 wherein said control means comprises means for storing coded data corresponding to said predetermined pattern and electrical means to convert the coded data into code related electrical pulses which are transmitted by said pulse transmission means.

3. In a tufting apparatus which includes means for moving a backing material along a path of travel, a plurality of yarn carrying tufting needles disposed transverse to said path, means for effecting relative cyclical movement between the needles and the backing material transversely of said path to cause penetration of the needles through and withdrawal of the needles from the backing material during each cycle, and means for feeding different controlled lengths of yarn to said needles to form in the backing material yarn loops of correspondingly different lengths extending from one side of the backing material and yarn back stitches extending between said loops on the other side of the backing material, the improvement in said controlled yarn feeding means which comprises:

feed roller means mounted at fixed feeding stations along the respective yarns for applying a frictional feeding force to individual yarns to move the yarns past said fixed stations, drive means to rotate said feed roller means through successive substantially uniform time intervals within individual cycles to move successive increments of yarn past said fixed stations, and means to control the operation of said drive means to selectively vary the number of said time intervals per cycle during which increments of the yarn are fed to form different ones of said loops to thereby vary the number of increments which are fed to said different loops and thus vary the relative lengths of said different loops in accordance with a predetermined pattern; said control means comprising:

means for storing coded digital data in the form of binary characters corresponding to said predetermined pattern, and electrical binary to analog converter means, operatively connected to said storage means and to said drive means, for converting the binary characters into discrete groups of electrical pulses and for transmitting said groups to said drive means, the number of pulses in each group being proportionally related to said coded digital data and to the number of increments of yarns supplied during a selected period to comprise a yarn length, and said drive means being responsive to said number of pulses received to supply a proportional number of yarn increments;

said binary to analog converter means comprising means for reading binary characters, binary counting means operatively coupled to said reading means for issuance of a signal proportional to a binary character, pulse generating means operatively coupled to said drive means by a pulse output line, and gating means in said output line responsive to said binary counting means signal and being operatively connected to said counting means for opening and closing said output line to thereby transmit the pulses to said drive means.

4. An apparatus as recited in claim 3 wherein said converter means further includes means for converting the reading and counting cycles whereby the transmission of said pulses will occur at said intervals whereby yarn is delivered in timed sequence to the movement of the needles.

5. An apparatus as recited in claim 4 wherein said needles are movable through various positions for manipulation of the yarn and including cooperative means connected to said needle moving means and said reading and counting cycle control means for controlling said cycles responsively to the position of said needles.

* * * * *

UNITED STATES PATENT OFFICE

CERTIFICATE OF CORRECTION

Patent No. 3,943,865 Dated March 16, 1976

Inventor(s) Joe T. Short, Lee H. Knight, Jr., Zane Frentress, Winston C. Boteler It is certified that error appears in the above-identified patent and that said Letters Patent are hereby corrected as shown below:

Column 1, line 42, "s" should read --a--.

Column 6, line 37, "moter" should read --motor--.

Column 6, line 57, "in" should read --by--.

Column 11, line 7, "ad" should read --and--.

Column 12, line 12, "two-input gates" should read --two-input and gates--.

Column 13, line 31, "three-input gates" should read --three-input and gates--.

Column 14, line 20, "261'" should read --216'--.

Column 11, lines 29, 34, 37, 39, 43, 44, 48, 50, 55, 58, 61, 64, 67 and 68, each time "and" appears before gate or gates, it should read --and--.

Column 12, lines 2, 3, 6, 12, 13, 16, 21, 22, 25, 26, 31, 33, 34, 38, 39 and 68, each time "and" appears before gate or gates, it should read --and--.

Column 13, lines 2 (both occurrences), 4, 5, 6, 13, 15, 19, 20, 21, 24, 27, 28, 31, 35, 37, 40, 41, 45, 46, 48, 54, 55 and 64, each time "and" appears before gate or gates, it should read --and--.

UNITED STATES PATENT OFFICE

CERTIFICATE OF CORRECTION

Patent No. 3,943,865 Dated March 16, 1976

Inventor(s) Joe T. Short, Lee H. Knight, Jr., Zane Frentress, Winston C. Boteler It is certified that error appears in the above-identified patent and that said Letters Patent are hereby corrected as shown below:

Column 14, lines 4, 5, 6, 63, 65 and 67, each time "and" appears before gate or gates, it should read --and--.

Column 15, lines 3, 8, 62 and 63, each time "and" appears before gate or gates, it should read --and--.

Column 16, lines 3, 19, 23, 33, 56, 58, 63, and 68, each time "and" appears before gate or gates, it should read --and--.

Column 17, line 3, "and" should read --and--.

Signed and Sealed this

Twenty-sixth Day of April 1977

[SEAL]

*Attest:*

RUTH C. MASON
*Attesting Officer*

C. MARSHALL DANN
*Commissioner of Patents and Trademarks*